US005100033A

United States Patent [19]

Cho

[11] Patent Number: 5,100,033

[45] Date of Patent: Mar. 31, 1992

[54] DISPENSING DEVICE FOR A CONTAINER

[76] Inventor: Chung-Kai Cho, No. 111, Alley 70, Lane 313, Wen-Hsien Rd., Tainan City, Taiwan

[21] Appl. No.: 580,953

[22] Filed: Sep. 11, 1990

[51] Int. Cl.[5] ..... B67D 3/00

[52] U.S. Cl. ..... 222/523; 222/562; 251/353

[58] Field of Search ..... 222/105, 521, 522, 523, 222/524, 563; 239/579, 541; 251/353; 215/311

[56] References Cited

U.S. PATENT DOCUMENTS

| | | | |
|---|---|---|---|
| 2,877,918 | 3/1959 | Gardner | 222/522 |
| 3,173,579 | 3/1965 | Curie et al. | 222/523 X |
| 3,203,665 | 8/1965 | Grant | 251/353 X |
| 3,261,513 | 7/1966 | Moran | 222/563 X |
| 3,305,145 | 2/1967 | Tebbutt | 222/563 X |
| 3,493,146 | 2/1970 | Conners | 222/523 X |
| 4,386,720 | 6/1983 | Speedie | 215/311 X |
| 4,595,126 | 6/1986 | Holmes | 222/105 |
| 4,836,416 | 6/1989 | Shalgi et al. | 222/105 X |
| 4,938,386 | 7/1990 | Roethel et al. | 222/105 X |
| 4,997,108 | 3/1991 | Hata | 222/105 |

FOREIGN PATENT DOCUMENTS

| | | | |
|---|---|---|---|
| 276994 | 8/1988 | European Pat. Off. | 222/105 |

*Primary Examiner*—Michael S. Huppert
*Assistant Examiner*—Gregory L. Huson
*Attorney, Agent, or Firm*—Ladas & Parry

[57] ABSTRACT

A dispensing device includes annular inner and outer mounting plates respectively adhered to inner and outer wall surfaces of a container. A first cylindrical member axially and outwardly extends from the annular outer mounting plate. A cap member is screwed onto the first cylindrical member and has a second cylindrical member axially extending therefrom. The second cylindrical member is hollow and has an outwardly diverging open end. A tubular stopper has an open end telescoped over the second cylindrical member of the cap member and a closed end having an inwardly extending inwardly tapered hollow plug member. The outwardly diverging open end of the second cylindrical member is closed by moving the stopper toward the cap member, enabling the plug member to fit into the outwardly diverging open end, and then opened by moving the stopper away from the cap member to detach the plug member from the outwardly diverging open end. The tubular stopper has a tubular outlet member formed on the wall thereof.

5 Claims, 5 Drawing Sheets

DISPENSING DEVICE FOR A CONTAINER

BACKGROUND OF THE INVENTION

This invention relates to a dispensing device, and more particularly to a dispensing device for a container having an outlet hole formed in the wall thereof, said dispensing device being mounted on said outlet hole of said container.

FIG. 1 shows a conventional container for mineral water, including a plastic bag (A) having a dispensing device (B) mounted on the lower portion thereof, and a cardboard box to hold said plastic bag (A) having a hole (C1) from which said dispensing device (B) protrudes. A user can open the dispensing device (B) to obtain mineral water contained in the plastic bag (A).

FIG. 2 shows a perspective exploded view of the conventional dispensing device (B). The dispensing device (B) includes inner and outer mounting plates (B1, B2) respectively adhered to the wall of the plastic bag (A). A central hole is formed in the inner and outer mounting plates (B1, B2) allowing mineral water to flow out. The outer mounting plate (B2) has a hollow cylindrical member extending from the central hole thereof. The cylindrical member has three studs (B21, B22, B23) formed on the internal surface thereof at equally spaced angular distances, and a first outlet hole (B24) is formed at the outer edge of said cylindrical member. A tubular stopper (B3) is rotatably inserted in the hollow cylindrical member of the outer mounting plate (B2). The tubular stop (B3) has a boss (B31) formed on the periphery of the open end thereof, and a second outlet hole (B32) formed in the wall thereof. The mineral water contained in the plastic bag (A) is permitted to flow out through the dispensing device when the tubular stopper (B3) is rotated to enable the second outlet hole (B32) to align with the first outlet hole (B24).

In assembling this device, the tubular stopper (B3) may be inserted into the cylindrical member of the outer mounting plate (B2) in any of three positions. In the first position, the boss (B31) of the stopper (B3) limits the rotation of the stopper (B3) to 120 degrees between the studs (B21, B22). When the boss (B31) abuts the stud (B21), the second outlet hole (B32) is aligned with the first outlet hole (B24), allowing the mineral water to flow out through said first and second outlet holes (B24, B32). In the second position, the boss (B31) limits the stopper (B3) to rotation between the studs (B21, B23). When the boss (B31) abuts the stud (B21), the second outlet hole (B32) is aligned with the first outlet hole (B24), allowing the mineral water to flow out through said first and second outlet holes (B24, B32). In the third position, the boss (B31) of the stopper (B3) limits the stopper (B3) to rotation between the studs (B22, B23). However, in the third position, the second outlet hole (B32) cannot be aligned with the first outlet hole (B24).

Therefore, the stopper (B3) must be inserted into the cylindrical member of the outer mounting plate (B2) in either the first or second position only, during the assembly processes. A manufacturer must insert the stopper (B3) into the cylindrical member in some specific orientation. In addition, since the stopper (B3) is snugly fitted in the cylindrical member of the outer mounting plate (B2) to prevent the leakage of the mineral water, the rotation of the stopper is energy-consuming.

SUMMARY OF THE INVENTION

It is therefore a main object of this invention to provide a dispensing device having a stopper which can be assembled without considering its orientation.

It is another object of this invention to provide a dispensing device which can be simply operated.

Accordingly, the dispensing device of this invention includes annular inner and outer mounting plates respectively adhered to inner and outer surfaces of the wall adjacent to an aperture in the wall of a container. Each of the inner and outer mounting plates has a central hole. Both of the central holes are aligned with the aperture of the container. A first cylindrical member axially and outwardly extends from the inner periphery of the annular outer mounting plate.

A cap member has an open end screwed to the first cylindrical member, and a closed end having a second cylindrical member axially extending therefrom. The second cylindrical member is hollow and has an outwardly diverging open end.

A tubular stopper has an open end telescoped with the second cylindrical member of the cap member and a closed end having an inwardly extending hollow plug member tapered to fit the end of the second cylindrical member. The outwardly diverging open end of the second cylindrical member is closed by moving the stopper toward the cap member, enabling the plug member to fit into the outwardly diverging open end, and then opened by moving the stopper away from the cap member to extract the plug member from the outwardly diverging open end. The tubular stopper has a tubular outlet member formed on the wall thereof. Therefore, the stopper can be mounted to the second cylindrical member of the cap member without considering its rotational orientation with respect to the second cylindrical member. In addition, flow from the container can be easily controlled by moving the stopper toward or away from said cap member, enabling the plug member to stop or open said outwardly diverging open end of the second cylindrical member. This is a simple operation because there is no need to rotate the stopper to align the outlet hole of the stopper with the outlet hole of the second cylindrical member.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
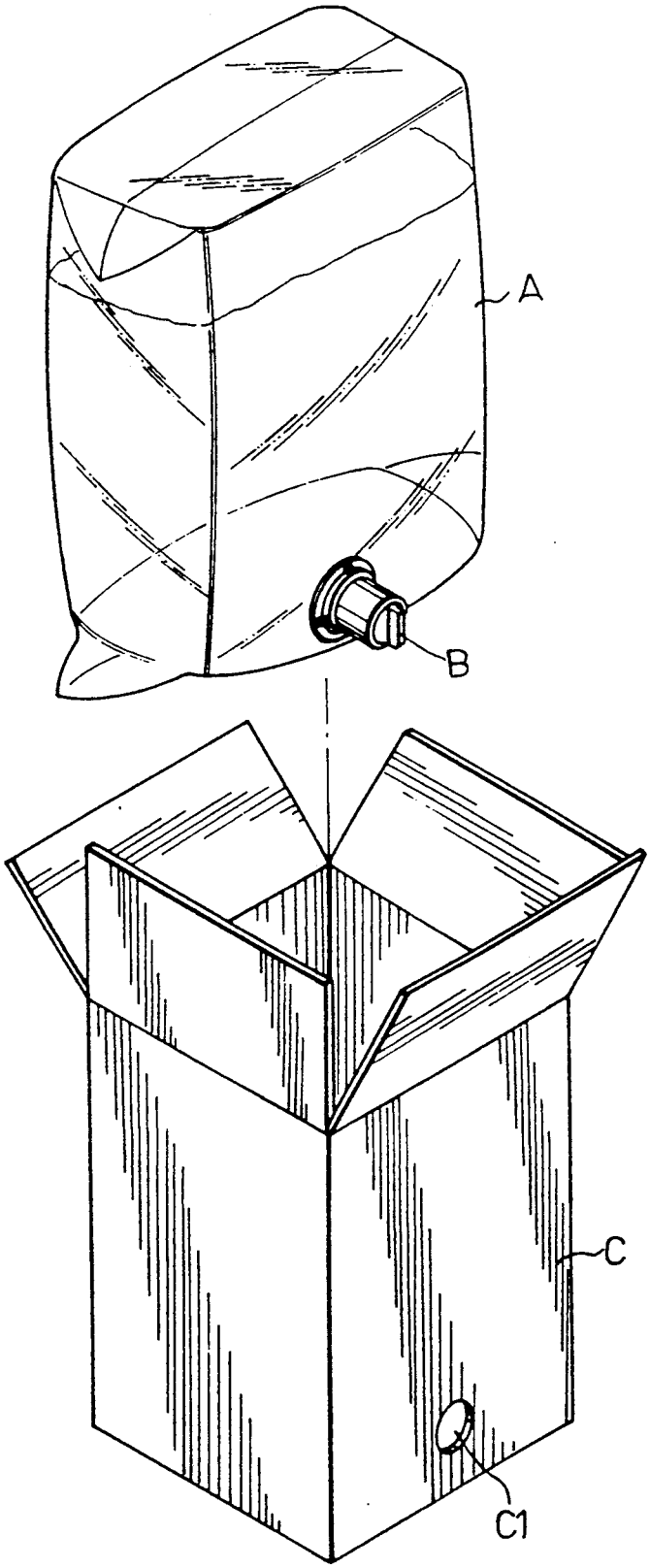
FIG 1 PRIOR ART
FIG. 1 is a perspective exploded view of a conventional container having a dispensing device mounted thereto.
Figure 2:
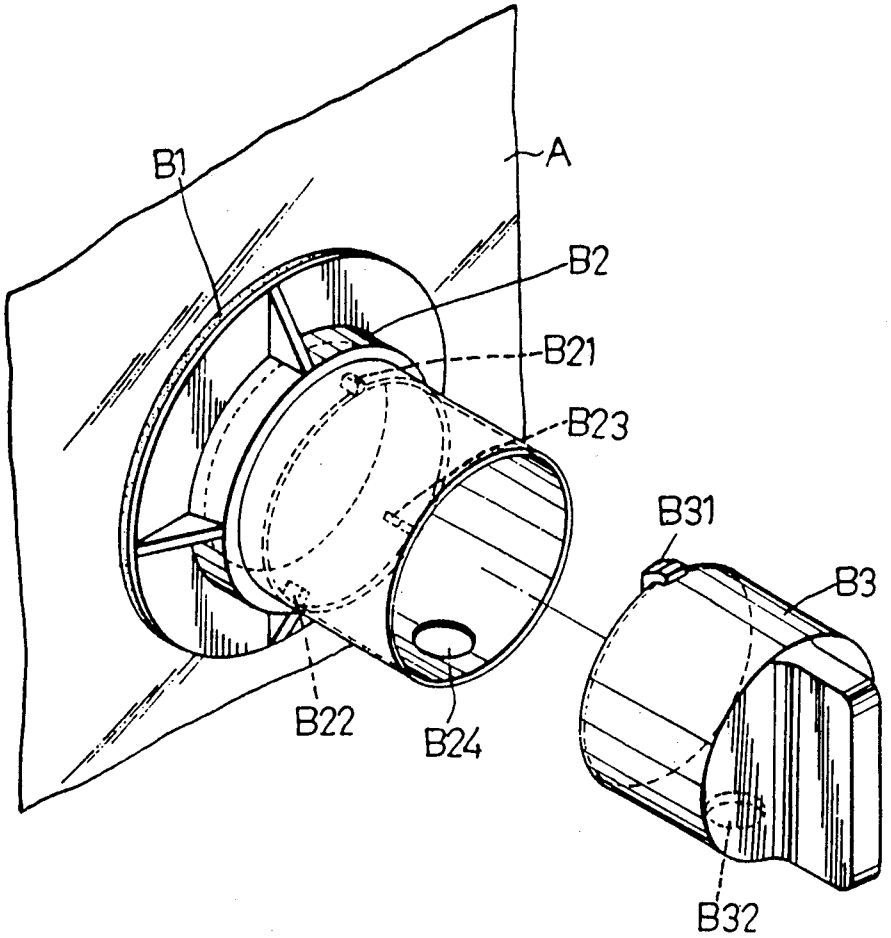
FIG. 2 PRIOR ART
FIG. 2 is a perspective exploded enlarged view of the conventional dispensing device of FIG. 1.
Figure 3:
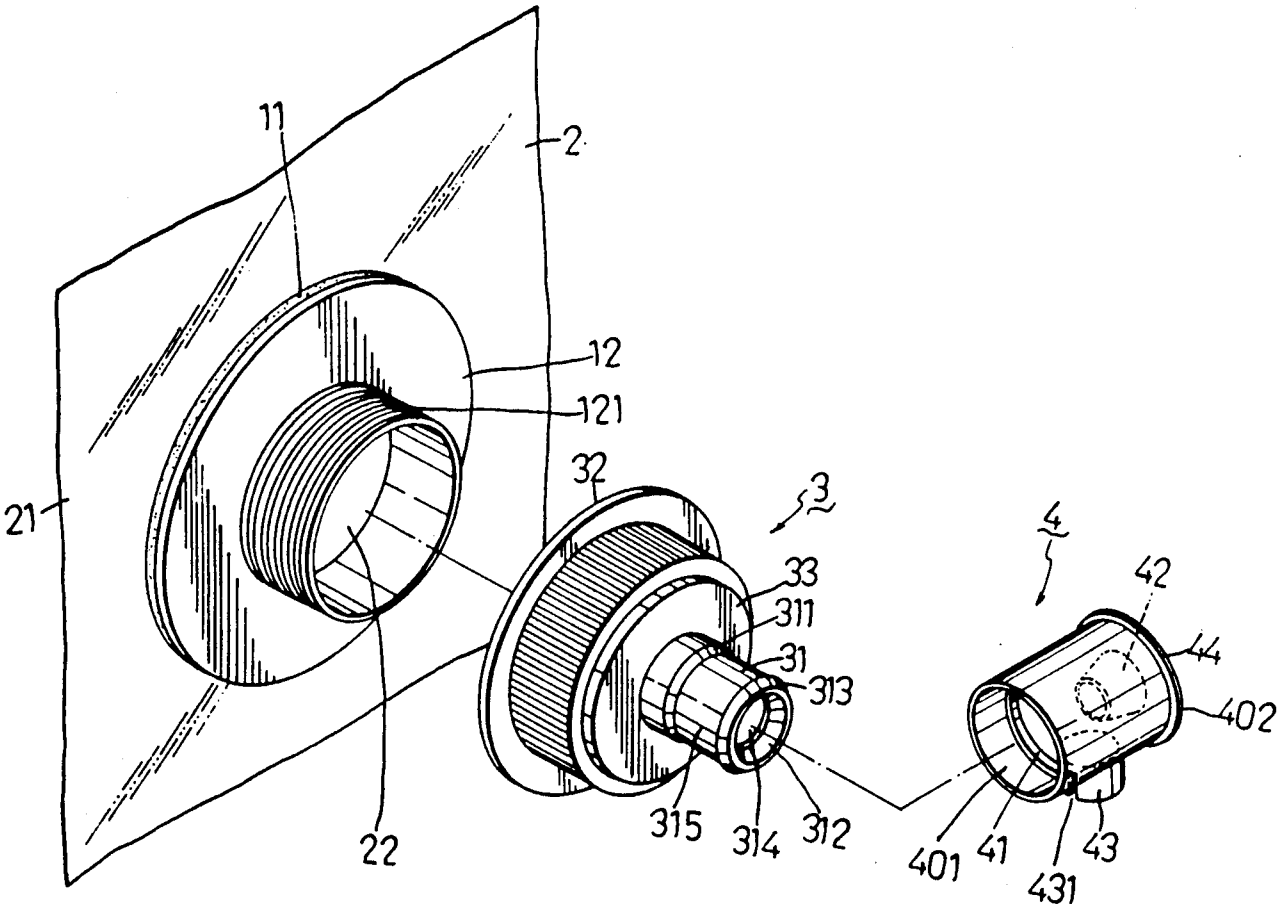
FIG. 3 is a perspective exploded view of a preferred embodiment of a dispensing device of this invention.

FIG. 3 shows a perspective exploded view of a preferred embodiment of a dispensing device for a container 2 having an aperture 22 formed at the lower portion of the plastic wall 21 of the container 2 according to this invention. The dispensing device includes annular inner and outer mounting plates 11 and 12 respectively adhered to the inner and outer surfaces of the wall 21 of the container 2, adjacent to the aperture 22 in the wall 21 of the container 2. The inner and outer mounting plates 11 and 12 have central holes registered with the aperture 22 of the container 2. A first cylindrical member 121 axially and outwardly extends from the inner periphery of the annular outer mounting plate 12. The first cylindrical member 121 is provided with an external thread on the outer surface thereof.

A cap member 3 has an open end 32 screwed onto the first cylindrical member 121, and a closed end 33 having a second cylindrical member 31 axially extending therefrom. The second cylindrical member has a throughbore 314 communicating with the internal space of the cap member 3, and an outwardly diverging open end 312. The second cylindrical member 31 has an outwardly radial flange 313 formed near the outwardly diverging open end 312 and a shoulder portion 311 formed near the closed end 33 of the cap member 3, defining a neck portion 315 between the outwardly radial flange 313 and the shoulder portion 311.

Figure 5:
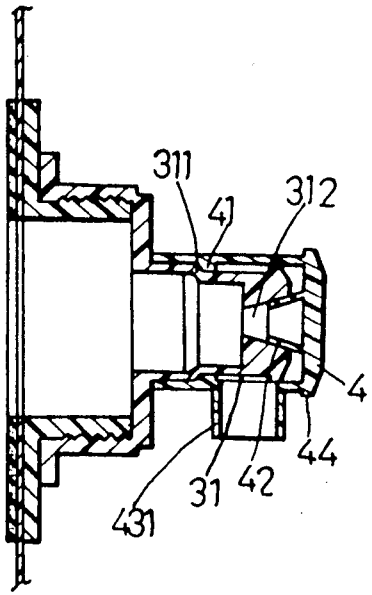
FIG. 5 is a sectional view of the preferred embodiment of the dispensing device of this invention in a closed position.
Figure 4:
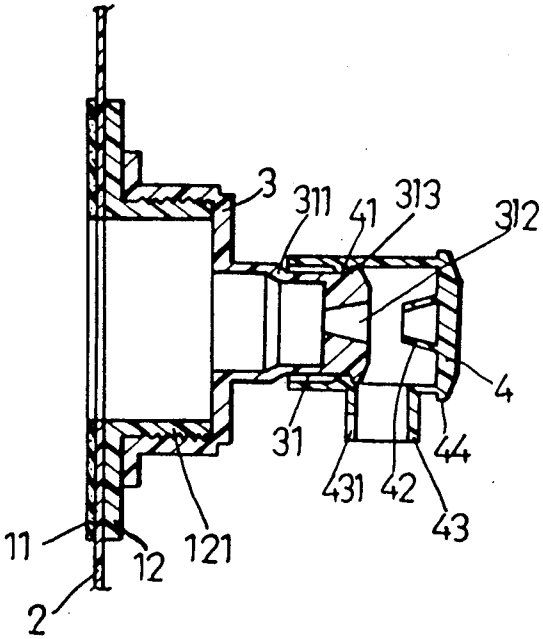
FIG. 4 is a sectional view of the preferred embodiment of the dispensing device of this invention in an open position.

A tubular stopper 4 has an open end 401 telescoped over the second cylindrical member 31 of the cap member 3 and a closed end 402 having an inwardly extending hollow plug member 42 tapered to fit the end of the second cylindrical member. The tubular stopper 4 has a tubular outlet member 43 formed on the wall thereof. The tubular stopper 4 further has an inwardly extending annular projection 41 sealingly sleeved around the neck portion 315 of the second cylindrical member 31, so that the tubular stopper can be axially moved along the second cylindrical member 31 of the cap member 3 between a first and a second position where the annular projection 41 of the tubular stopper 4 respectively abuts the outwardly radial flange 313 and the shoulder portion 311 of the second cylindrical member 31, as best illustrated in FIGS. 4 and 5, without leaking. In the second position, the outwardly diverging open end 312 of the second cylindrical member 31 is closed when the stopper 4 is moved toward the cap member 3, enabling the plug member 42 to fit into the outwardly diverging open end 312. Then, the outwardly diverging open end 312 can be opened by moving the stopper 4 away from the cap member 3 to extract the plug member 42 from the outwardly diverging open end 312. This allows the mineral water in the container 2 to flow through the aperture 22, the throughbore 314, and the tubular outlet member 43 of the stopper 4, and out. The tubular outlet member 43 has a notch 431 formed in the free end thereof to dissipate the surface tension of a water drop which tends to linger at the free end of the tubular outlet member 43 when said tubular outlet member 43 is not provided with said notch 431. Thereby, drops will not form at the free end of the tubular outlet member 43 after the water flow is stopped by the stopper in a manner as hereinbefore described. Therefore, this dispensing device is sanitary.

It is noted that, in accordance with the present invention, the stopper 4 can be mounted to the second cylindrical member 31 of the cap member 3 without considering its rotational orientation with respect to the second cylindrical member. In addition, flow from the container can be easily controlled by moving the stopper 4 toward or away from the cap member 3, enabling the plug member 42 to stop or open the outwardly diverging open end 312 of the second cylindrical member 31. This is an energy-saving and a simple operation because there is no need to rotate the stopper 4 relative to the second cylindrical member to align outlet holes. A conventional device necessitates these rotation and alignment operations.

Figure 6:
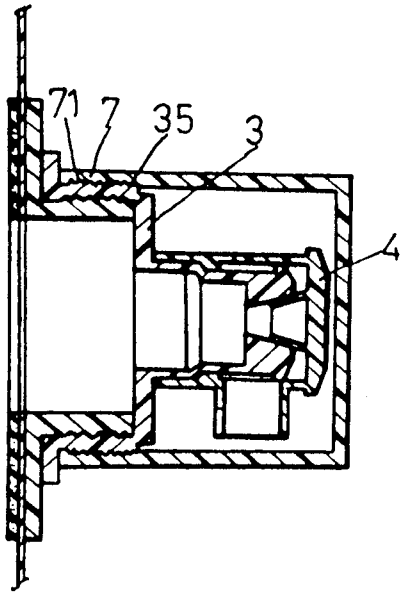
FIG. 6 is a sectional view of another preferred embodiment of a dispensing device of this invention.

FIG. 6 shows another preferred embodiment of a dispensing device of this invention. In this embodiment, the cap member 3 is provided with an external screw thread 35 at the outer surface thereof. A hollow cylindrical cover 7 with an internal screw thread 71 is screwable onto the cap member 3. Therefore, the cap member 3 and the stopper 4 can be contained and protected by the cylindrical cover 7 when the dispensing device is in the closed position and not in use, thus preventing said dispensing device from being contaminated by dust, sand, etc.

With this invention thus explained, it is apparent that numerous modifications and variations can be made without departing from the scope and spirit of this invention. It is therefore intended that this invention be limited only as indicated in the appended claims.

I claim:

1. A dispensing device for a container, said container having a wall with an aperture and comprising:

annular inner and outer mounting plates respectively adhered to inner and outer surfaces of said wall adjacent to said aperture in said wall, each of said inner and outer mounting plates having a central hole, both of said central holes being aligned with said aperture of said container, said annular outer mounting plate having a first cylindrical member axially and outwardly extending from an inner periphery thereof;

a cap member having an open end, and a closed end with an opening, said open end having threads thereon and being screwed onto mating threads on said first cylindrical member, said closed end having a second cylindrical member axially extending therefrom, said second cylindrical member having a throughbore aligned with said opening, said second cylindrical member throughbore having an outwardly diverging open end; and a tubular stopper having an open end telescoped with said second cylindrical member of said cap member and a closed end, said closed end of said stopper having an inwardly extending inwardly tapered hollow plug member so that said outwardly diverging open end of said second cylindrical member throughbore can be closed by moving said stopper towards said cap member enabling said plug member to fit into said outwardly diverging open end throughbore and then opened by moving said stopper away from said cap member to extract said plug member from said outwardly diverging open end throughbore, said tubular stopper further having a tubular outlet member formed on a wall thereof fluidly connected to said throughbore when said stopper is in said open position.

2. A dispensing device for a container as claimed in claim 1, wherein said second cylindrical member has an outwardly radial flange formed near said outwardly diverging open end and a shoulder portion formed near said closed end of said cap member, defining a neck portion between said outwardly radial flange and said shoulder portion; and said tubular stopper has a inwardly extending annular projection to be sealingly sleeved around said neck portion of said second cylindrical member, so that said tubular stopper can be axially moved along said second cylindrical member of said cap member between a first and a second position where said annular projection of said tubular stopper respectively abuts said outwardly radial flange and said shoulder portion of said second cylindrical member, without leaking.

3. A dispensing device for a container as claimed in claim 1, wherein said tubular stopper has a outwardly radial flange formed near said closed end thereof.

4. A dispensing device for a container as claimed in claim 1 further having a hollow cylindrical cover member screwed onto said cap member so that said cap member and said tubular stopper member are received therein.

5. A dispensing device for a container as claimed in claim 1, wherein said tubular outlet member has a notch formed in an free end thereof.

* * * * *